US006457531B1

(12) United States Patent
Bangash et al.

(10) Patent No.: US 6,457,531 B1
(45) Date of Patent: Oct. 1, 2002

(54) WATER SEPARATION SYSTEM WITH ENCAPSULATED ELECTRIC SUBMERSIBLE PUMPING DEVICE

(75) Inventors: Yasser Khan Bangash, Norman, OK (US); Michael R. Berry, Norman, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 13 days.

(21) Appl. No.: 09/725,558

(22) Filed: Nov. 28, 2000

Related U.S. Application Data

(60) Provisional application No. 60/210,729, filed on Jun. 9, 2000, and provisional application No. 60/222,893, filed on Aug. 3, 2000.

(51) Int. Cl.[7] ..... E21B 43/12

(52) U.S. Cl. ..... 166/369; 166/105

(58) Field of Search ..... 166/243, 265, 166/357, 105, 105.5, 305.1, 369, 313

(56) References Cited

U.S. PATENT DOCUMENTS

| | | | | |
|---|---|---|---|---|
| 4,296,810 A | | 10/1981 | Price | |
| 4,688,650 A | | 8/1987 | Hayatdavoudi et al. | |
| 4,738,779 A | | 4/1988 | Carroll et al. | |
| 4,805,697 A | | 2/1989 | Fouillout et al. | |
| 4,844,817 A | | 7/1989 | Flanigan et al. | |
| 5,110,471 A | | 5/1992 | Kalnins | |
| 5,154,826 A | | 10/1992 | Prendergast et al. | |
| 5,296,153 A | | 3/1994 | Peachey | |
| 5,302,294 A | | 4/1994 | Schubert et al. | |
| 5,335,732 A | | 8/1994 | McIntyre | |
| 5,456,837 A | | 10/1995 | Peachy | |
| 5,482,117 A | | 1/1996 | Kolpak et al. | |
| 5,693,225 A | | 12/1997 | Lee | |
| 5,711,374 A | | 1/1998 | Kjos | |
| 5,730,871 A | | 3/1998 | Kennedy et al. | |
| 5,860,476 A | * | 1/1999 | Kjos | 166/265 |
| 6,017,456 A | | 1/2000 | Kennedy et al. | |
| 6,068,053 A | | 5/2000 | Shaw | |
| 6,079,491 A | * | 6/2000 | Stuebinger et al. | 166/266 |
| 6,082,452 A | * | 7/2000 | Shaw | 166/105.5 |
| 6,131,655 A | | 10/2000 | Shaw | |
| 6,189,613 B1 | * | 2/2001 | Chachula et al. | 166/265 |
| 6,196,312 B1 | * | 3/2001 | Collins et al. | 166/265 |
| 6,260,626 B1 | * | 7/2001 | Rivas | 166/369 |

FOREIGN PATENT DOCUMENTS

| | | | |
|---|---|---|---|
| GB | 2339818 A | * | 2/2000 |

* cited by examiner

*Primary Examiner*—Frank Tsay
(74) *Attorney, Agent, or Firm*—Crowe & Dunlevy

(57) ABSTRACT

The present invention provides a downhole water separation system with an encapsulated electric submersible pumping device for the separation and transfer of different density fluids in downhole applications. The encapsulated device works in conjunction with a separator and packer, using a pump assembly and a motor assembly that are contained in an enclosed device, to separate fluids with a minimum use of conduits. The pump and motor are part of an encapsulated single device, and the separation system arrangement permits the motor and pump to be either above or below the separator.

19 Claims, 6 Drawing Sheets

WATER SEPARATION SYSTEM WITH ENCAPSULATED ELECTRIC SUBMERSIBLE PUMPING DEVICE

RELATED APPLICATION

This application claims priority to Provisional Application No. 60/210,729 entitled "Encapsulated Pumping System" filed Jun. 9, 2000 and to Provisional Application No. 60/222,893 entitled "Downhole Oil Water Separation System" filed Aug. 3, 2000.

FIELD OF INVENTION

The present invention relates generally to the field of downhole water separation, and more particularly, but not by way of limitation, to a downhole water separation system having a submersible pump.

BACKGROUND OF INVENTION

Fluid separation systems are an important and expensive part of most hydrocarbon production facilities. The separation of fluids based on different properties is known in the industry. A variety of separation methods are used, including gravity separators, membrane separators and cyclone separators. Each of these separator types uses a different technique to separate the fluids and each achieves a different efficiency depending upon the device and its application.

Gravity separators, for instance, can be efficient when there is a great density difference between the two fluids and there are no space or time limitations. Another type of separator, the membrane separator, uses the relative diffusibility of fluids for separation. Any separation method that is time dependant, such as the above mentioned gravity and membrane separators, does not work well with an electric submersible pump due to the high pressure and rates involved with these pumps.

Electric submersible pumps (ESP) are capable of producing fluids in a wide volume and pressure range, and thus submersible pumps are often used for downhole fluid production. Such pumps are also used very efficiently for applications where downhole oil water separation devices are used. As already noted, gravity and membrane separators do not work well with an electric submersible pump. Hydro cyclone separators, on the other hand, have been used effectively with electric submersible pumps, both on the surface and in below the surface applications.

Hydro cyclone separators are non-rotating devices, using a specific geometric shape to induce fluid rotation. The fluid rotation creates high g-forces in the fluids as the fluids spin though the device, resulting in the lighter fluids forming a core in the middle of the separator. In the separation of oil and water mixtures, the inner core is extracted out of the topside of the hydro cyclone separator as an oil stream. The separated water is rejected from the bottom side. One problem associated with this type of separator is the large pressure drop experienced as the fluid passes through the hydro cyclone.

A system design that incorporates use of an ESP system with a hydro cyclone is often complicated. Depending upon the relative locations of the disposal and production zones, these systems usually have one or two conduits running from the separator and pump to the respective zones or are limited on where the systems can be placed in relation to the positioning of the pumps. The conduits not only cause excessive pressure drops in the fluids but also arc the weak links in the design, often causing mechanical problems during installation.

There is a need in the industry for a more efficient, simpler device for separation of different density fluids that is capable of operating in smaller diameter wellbores.

The present invention provides a system using a separation device in conjunction with an encapsulated submersible pumping device.

SUMMARY OF INVENTION

The present invention provides a downhole water separation system coupled with an encapsulated electric submersible pumping device for the separation and transfer of fluids of different densities in downhole applications. The encapsulated device works in conjunction with a separator and packer, having a pump assembly and a motor assembly that are contained in an enclosed device to separate fluids with a minimum use of conduits. Since the pump and motor are part of an encapsulated single device, the separation system arrangement is not restricted to one in which the motor and pump must be directly above or below the separator.

The objects, advantages and features of the present invention will become clear from the following detailed description and drawings when read in conjunction with the claims.

BRIEF DESCRIPTION OF DRAWINGS

FIG. 6 is a diagrammatical, partially detailed, elevational view of the system of FIG. 1 as modified by the addition of a second packer.

DETAILED DESCRIPTION

Figure 1:
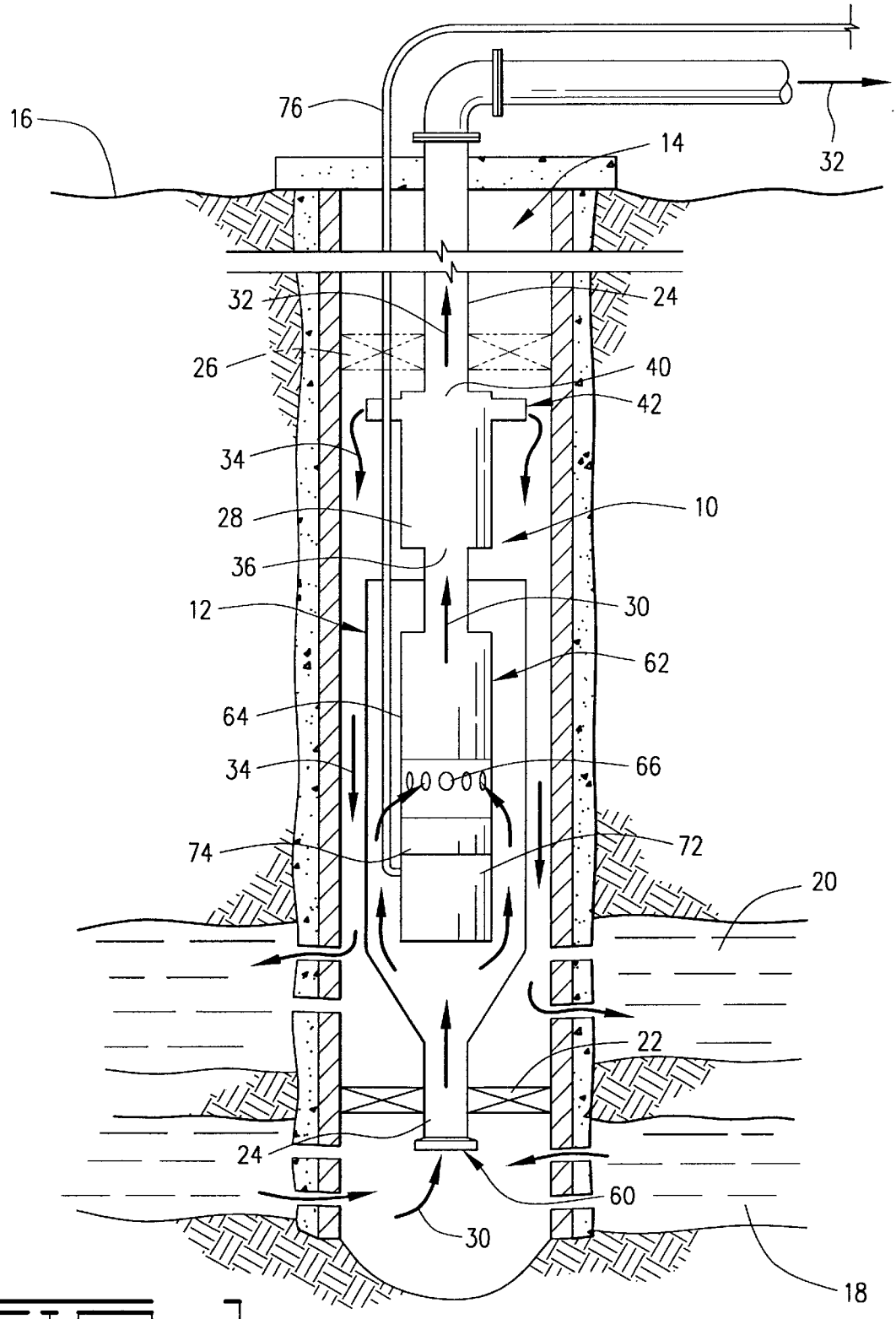
FIG. 1 is a diagrammatical, partially detailed, elevational view of a downhole water separation system with an encapsulated electric submersible pumping device constructed in accordance with the present invention.

Referring generally to the drawings, and in particular to FIG. 1, shown therein is a downhole water separation system 10 constructed in accordance with the present invention. The separation system 10 has an encapsulated electric submersible pumping device 12 for use in a wellbore 14 below the earth's surface 16 and extending through a hydrocarbon producing zone 18 and a water injection zone 20. It will be understood by those skilled in the art that the hydrocarbon producing zone 18 will actually produce a hydrocarbon and water mixture with the percentage of water varying from an acceptable level where it is economical to separate produced water downhole with the use of a oil water separator. It is to the latter situation that the present invention is directed.

A conventional first packer 22 is set on a tubing 24 which is disposed in the wellbore 14 and is attached to the separation system 10. The first packer 22 separates the hydrocarbon production zone 18 and the water injection zone 20 in the wellbore 14. A second packer 26 can be disposed above the first packer 22, if necessary. The separation system 10 also includes a separator 28 which separates a produced hydrocarbon and water fluid mixture 30 into a hydrocarbon-rich stream 32 and a water-rich stream 34.

The separator 28 has an inlet 36 in fluid communication with the encapsulated electric submersible pumping device 12, a first outlet 40 for the hydrocarbon-rich stream 32 and a second outlet 42 for the water-rich stream 34. The separator 28 can be any type of separator capable of separating fluids of different properties such as density. One such separator is a single or multistage hydro cyclone separation device like the one described in Reed Well Service's U.S. Pat. No. 5,860,476 and Norwegian Pat #19,980,767. Another is a rotary separator such as the one described in the applicants co-pending application Ser. No. 60/211,868. One skilled in the art will recognize other separators that could separate fluids by properties such as density.

The separator 28 is in fluid communication with the encapsulated electric submersible pumping device 12. The encapsulated electric submersible pumping device 12 can communicate with the production fluid 30 through a piece of standard tubing attached to the bottom adapter of the electric submersible pumping device 12. Produced fluid 30 is pressurized by a pump and fed into the separator that separates the fluids based on different densities. The heavier fluid in the water-rich stream 34 is transferred to the injection zone 20 and the lighter fluid (less dense) in the hydrocarbon-rich stream 32 is transferred to the surface 16 through the tubing 24.

Figure 2:
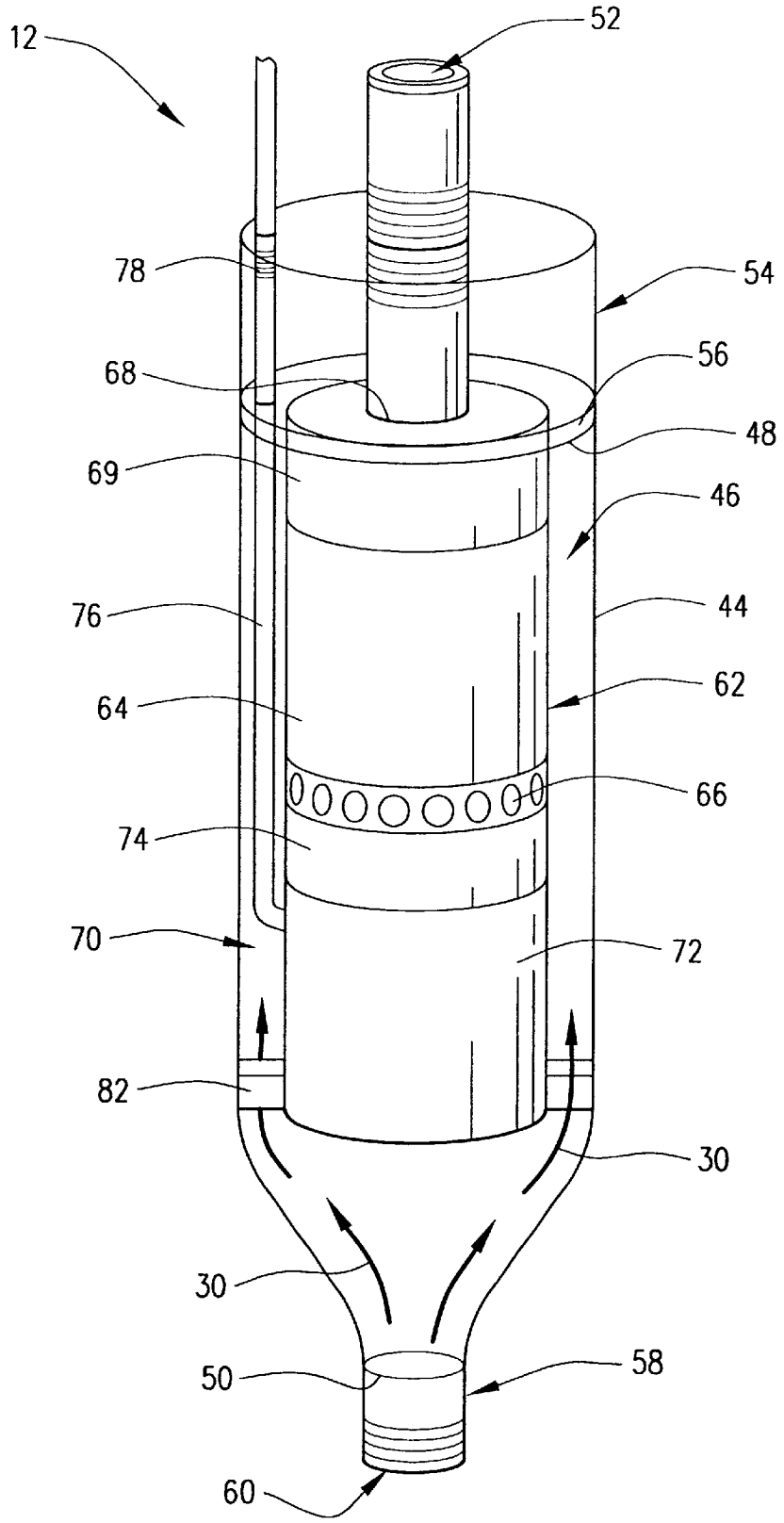
FIG. 2 is a diagrammatical representation in perspective of the encapsulated electric submersible pumping device of FIG. 1.

FIG. 2 shows the encapsulated electric submersible pumping device 12 for use in the wellbore 14. The encapsulated device 12 is in fluid communication with the separator 28 (shown in FIG. 1) and the production zone 18. The encapsulated electric submersible pumping device 12 has a device body 44 forming a chamber 46 having an upper surface 48 and a lower surface 50. The upper surface 48 is in fluid communication with a device outlet 52 and abuts an upper connection device 54 via a pressure seal 56. The upper connection device 54 provides a means of hanging the encapsulated device 12 by the use of a pup joint screwed into the upper connection device 54. Tubing string can be attached to the top of the upper connection device 54, allowing fluid communication with the separator 28.

The lower surface 50 abuts a lower connection 58 and is in fluid communication with a device inlet 60. The lower connection 58 provides a connection for standard tubing. Supported inside the device body 44 is a pump assembly 62 which has a multi-stage submersible pump 64 with a pump inlet 66 in fluid communication with the production zone 18 via inlet 60. The pump 64 also has a pump outlet 68, shown here in a pump discharge header 69, which is in fluid communication with the device outlet 52.

The encapsulated electric pumping device 12 also includes an electric submersible motor assembly 70 that drives the multi-stag,e submersible pump 64. This motor assembly 70 includes an electric submersible motor 72 supported in the device body 44. A seal section 74 is attached between the pump 64 and the motor assembly 70. The electric submersible motor 72 is produced by companies such as the assignee (models WG-ESP TR-4 and TR-5). The device body 44 also includes a means of power transfer. Such as a power cable 76, for transferring power from a power source to the electric submersible motor assembly 70 through a power connector 78 with a pressurized seal. Special provisions can be made in the upper connection device 54 to install a feed-through system for the power cable 76. Such systems provide means of running cable inside encapsulated systems by providing high pressure sealing connections. These systems are readily available from vendors such as QCI (the assignee's part number for such a system is ESP 145395).

The produced fluid mixture 30 flows past the motor 72, helping to achieve the required cooling by keeping the velocity of fluid around the motor 72*a* minimum of 1 ft/sec. The produced fluid mixture 30 then enters the pump inlet 66 to be forced into the separator 28 via outlet 52. The produced fluid mixture 30 is pressurized and is discharged from the pump discharge head 69 into the separator 38 through tubing 79 (FIG. 1). The separator 28 separates the fluid stream 30 into two streams, the hydrocarbon-rich stream 32 which is produced to the surface and the water-rich stream 34 which is injected into the injection zone 20. The advantage of this system is that it minimizes the use of conduits to transport fluids to the injection zone 20.

Figure 3:
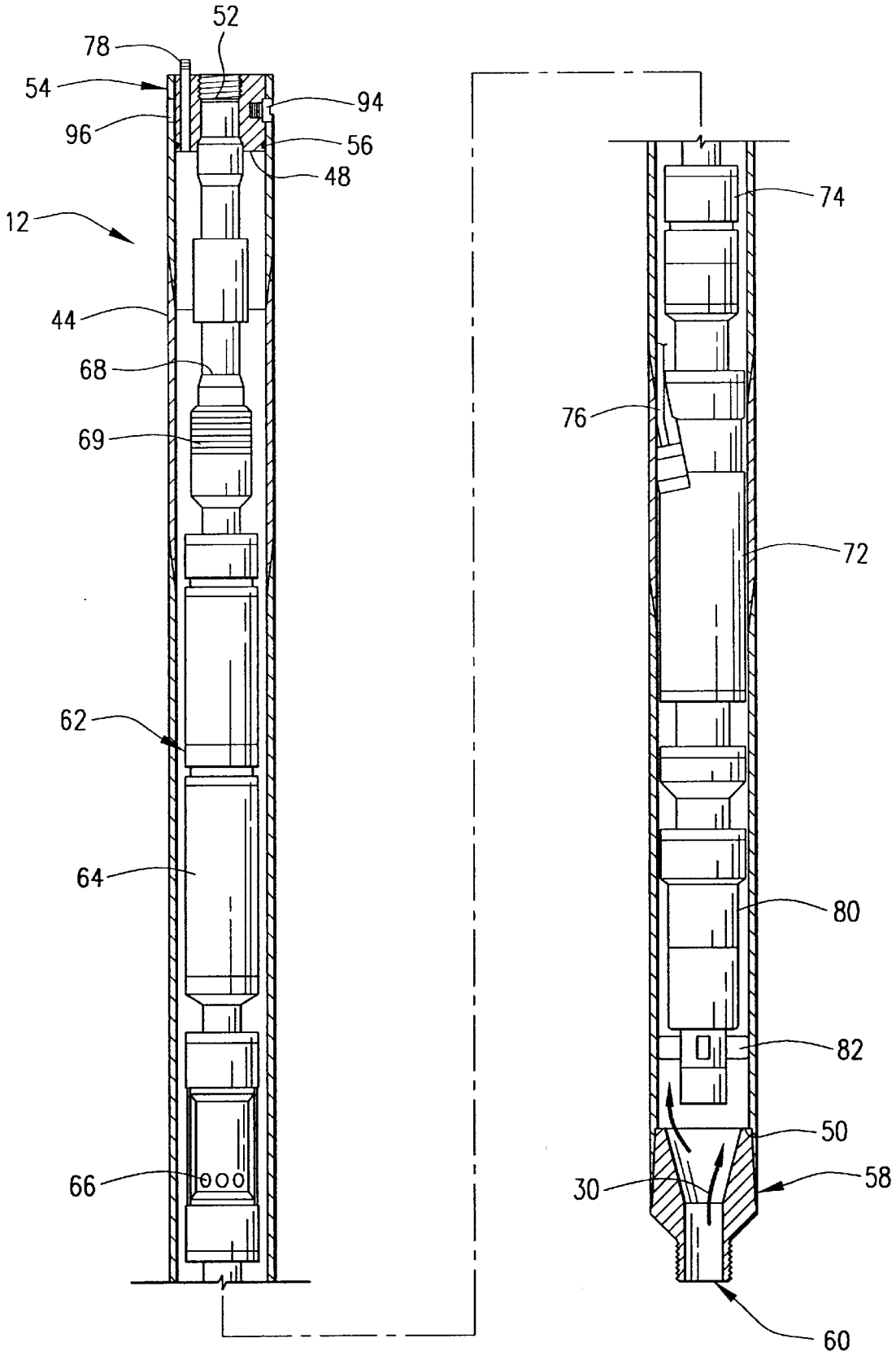
FIG. 3 is a partially detailed, elevational view of the encapsulated electric submersible pumping device of FIG. 1.

FIG. 3 shows the encapsulated electric submersible pumping device 12 of the present invention in more detail. The device body 44 is made up of a series of casing joints screwed together. The power cable 76 has been removed to make the components of the encapsulated electric submersible pumping device 12 easier to show.

One skilled in the art will recognize that the encapsulated electric submersible pumping device 12 can have additional components such as a sensor 80 located adjacent the motor 72 for sensing mechanical and physical properties, such as vibration, temperature, pressure and density, at that location. The sensor 80 is commercially available, such as Promore MT12 or MT13 models, and one or more sensors 80 can also be located adjacent to the pump 64, the separator 28 or the surface 14. One skilled in the art will understand that such sensors would be helpful to the operation of the encapsulated electric submersible pumping device 12. It is also well known that the use of a centralizer 82, as shown in FIG. 3, can optimize performance of the system.

Figure 4:
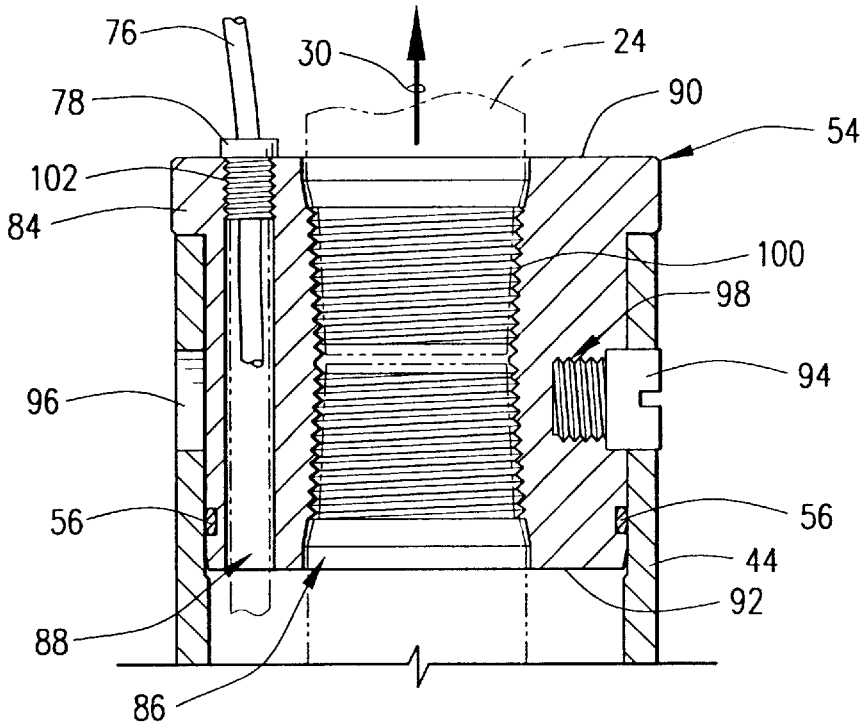
FIG. 4 is a partially detailed, elevational view of the upper portion of the device of FIG. 1.

FIG. 4 shows the upper connection 54 of the encapsulated electric submersible pumping device 12. The upper connection 54 is a hanger with a hanger body 84 forming a first chamber 86 and a second chamber 88. The upper connection 54 has an upper surface 90 (which is the same as the device upper surface 48 in FIG. 2), and a lower surface 92. The hanger body 84 of the upper connection 54 is supported by the device body 44 and secured with fasteners 94 that connect an opening 96 in the device body 44 and an opening 98 in the hanger body 84.

The first chamber 86 has a means of connection, which in the present invention is a threaded connection 100, capable of supporting the pump assembly 62 in the hanger body 84. The second chamber 88 has a means of connection, which in the present, invention is a threaded connection 102, capable of supporting a cable connection (not shown) in the hanger body 84. The hanger body 84 supports the pressure seal 56 between the device body 44 and the hanger body 84. The seal 56 is capable of isolating, the pressure from below the hanger body 84 from the pressure above tile hanger body 84.

Figure 5:
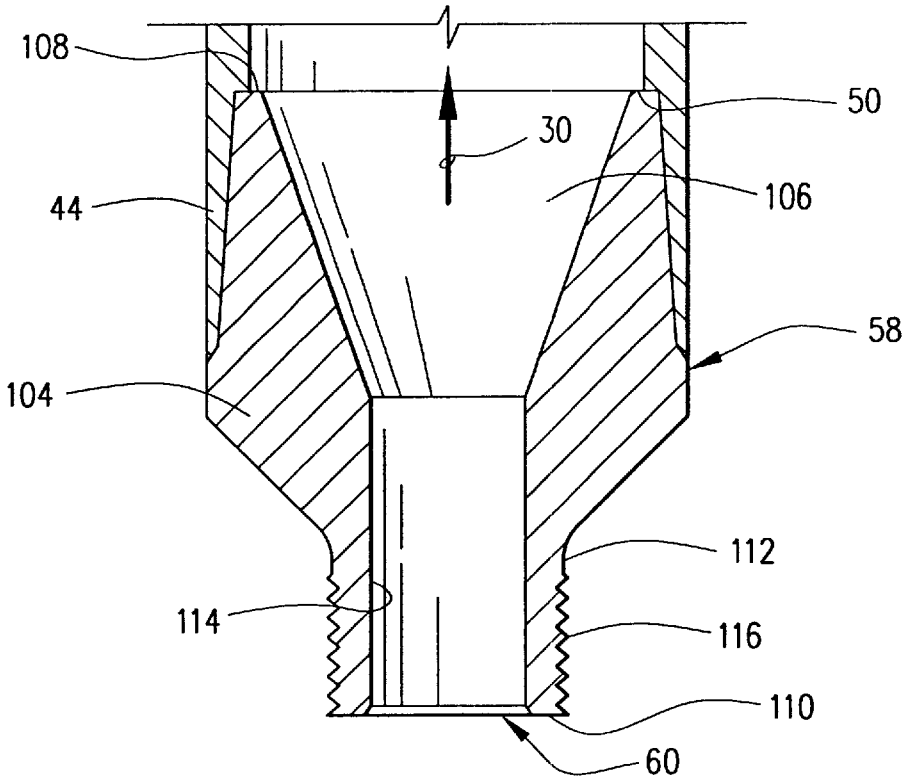
FIG. 5 is a partially detailed, elevational view of the lower portion of the device of FIG. 1.
Figure 5:
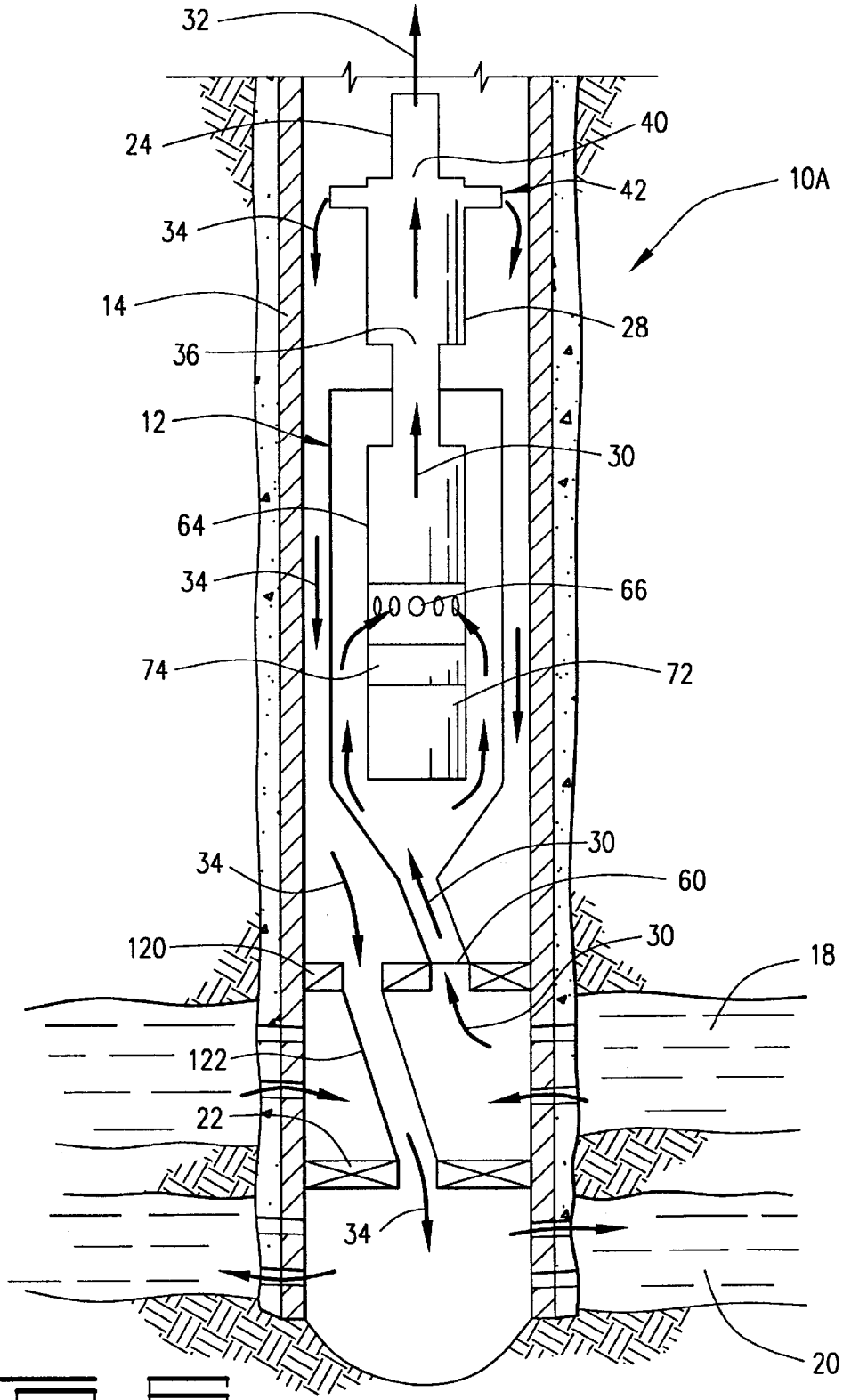

FIG. 5 shows the lower connection 58 of the encapsulated electric submersible pumping device 12. The lower connection 58 has a base body 104 forming, a chamber 106 having an upper surface 108 and a lower surface 110, which is the device lower surface 50 (FIG. 2). The base body 104 of the lower connection 58 is supported by the device body 44 and can be attached thereto with fasteners such as screws or by welding. The base body 104 can also be secured to the device body 44 by a press fit or a design feature, Such as a lip, Coupled with external forces. The base body 104 has an outer Surface 112 and an inner surface 114. The outer surface 112 has threads 116 and is capable of supporting other devices, such as joints of tubing. The base body 104 contains the encapsulated device inlet 60 for accepting the flow of produced fluid mixture 30.

A joint of tubing can be screwed into the base 104 of the lower connection 58 and such tubing can sting into the first packer 22. A control valve (not shown) can be installed with the packer so that when the control valve is open, the produced fluids 30 communicate with the pump 64.

FIG. 6 shows a downhole water separation system 10A with the encapsulated electric submersible pumping device 12, similar to that described above, but with the location of the production zone 18 and injection zone 20 switched. In this case, the injection zone 20 is below the production zone 18 This change in the relative vertical zone location and/or distance between zones does not require a chance in design to the encapsulated electric submersible pumping device 12. All that is required is an additional packer 120 above the first packer 22 and an additional length of production tubing 122. The produced fluid mixture 30 is pressurized in the encapsulated electric submersible pumping device 12 and enters the separator 28 that is attached to the top of the encapsulated electric submersible pumping device 12. The separator 28 separates the produced fluid mixture 30) into lower density (oil-rich) stream 32 and the higher density (water-rich) stream 34. The water rich stream 34 is discharged from the separator at the second outlet 42 and passes through the tubing 122 to enter the injection zone 20.

Figure 7:
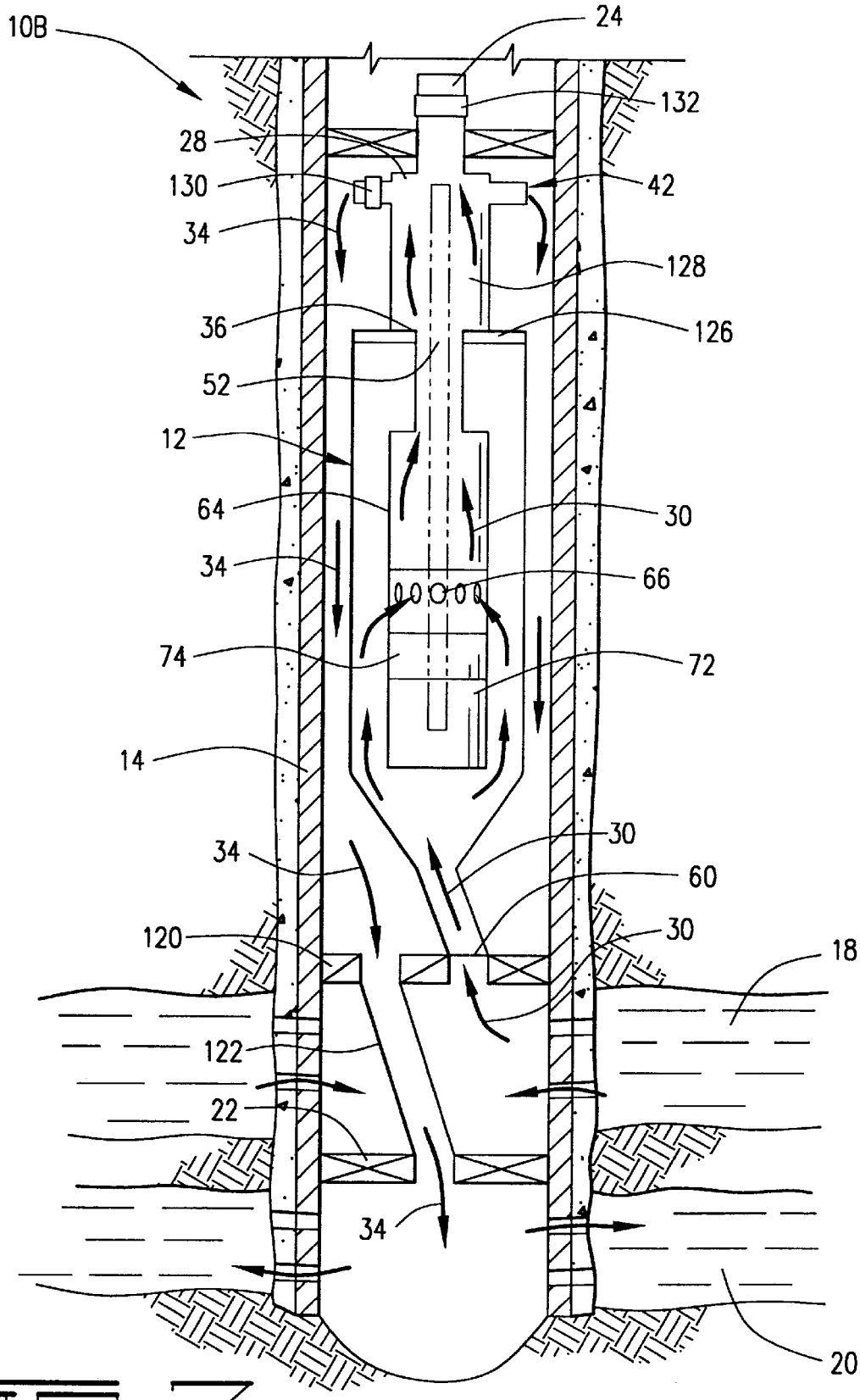
FIG. 7 is a diagrammatical, partially detailed, elevational view of the system of FIG. 1 modified by placing the encapsulated electric submersible pumping device directly below a rotary separator to allow torque transfer between the motor and pump to the separator.

FIG. 7 shows a downhole water separation system 10B with the encapsulated electric submersible pumping device 12, similar to that described above, but with a torque transfer adapter 126 connecting a separator 128 with the encapsulated electric submersible pumping device 12. The adapter 126 can serve as the connection between the separator 128 and the encapsulated electric submersible pumping device 12. The torque transfer adapter 126, a device that is well known by those skilled in the art, has intermeshed gears connected by shafts. The torque transfer adapter 126 can be located in the device body 44 or in the upper connection 54. The rotary separator 128 can also offer a means of transferring torque to other rotary devices above or below the rotary separator 128 and above or below the encapsulated device 12.

It will be clear to those skilled in the art that more than one encapsulated electric submersible pumping device 12 could be used in one wellbore. It will also be clear to those skilled in the art that additional separators, pumps and or motors can be used in conjunction with the encapsulated electric submersible pumping device 12 as well as permanent and semi-permanent packers.

The downhole water separation system 10B with the encapsulated electric submersible pumping device 12 can be incorporated as one part of a larger system to perform other essential downhole functions. For instance, a gas separator can be attached to the downhole water separation system 10B with an encapsulated electric submersible pumping device system 12 to handle excess gas before the gas passes through the separator 128.

The production zone 18 and the injection 20 zone can also be separated by other downhole means, Such as a liner hanger instead of the stand alone packer 22. The downhole water separation system with the encapsulated electric submersible pumping device 12 is designed to work with the other tools that one skilled in the art uses to produce hydrocarbons and inject fluids in a downhole environment.

The separator 128 can be regulated by monitoring either the water content of the hydrocarbon-rich stream 32 or the oil content of the water-rich stream 34. The sensor 80 can be used to determine the fluid density and relative hydrocarbon content. Based on this data, the relative flow rates can be regulated by adjusting a water-rich stream choke 130, a hydrocarbon-rich stream choke 132 and the operating speed of the motor 72.

While presently preferred embodiments have been described for purposes of this disclosure, numerous changes may be made, some indicated above, which will readily suggest themselves to one skilled in the art and which are encompassed in the spirit of the invention disclosed and as defined in the appended claims.

We claim:

1. A downhole water separation system for use in a wellbore, the system comprising:

a packer disposed in the wellbore and connected to the wellbore such that the packer separates a production zone from an injection zone;

a separator having an inlet and a first outlet and a second outlet such that a produced hydrocarbon and water mixture enters from the production zone through the inlet and is separated into an hydrocarbon-rich stream and a water-rich stream that can be ejected through the first and second outlets respectively; and an encapsulated device in fluid communication with the separator for pressurizing the hydrocarbon and water mixture for separation comprising:

a device body forming a chamber having an upper and lower surface such that the upper surface includes a device outlet and abuts an upper connection that includes a pressure seal and the lower surface includes a device inlet in fluid communication with the produced hydrocarbon and water mixture and abuts a lower connection;

a pump assembly supported by the device body, with a pump inlet in fluid communication with the produced hydrocarbon and water mixture and a pump outlet in fluid communication with the pressure sealed device outlet; and an electric submersible motor assembly.

2. The system of claim 1 wherein a second packer is disposed in the wellbore above the packer such that the device inlet is in fluid communication with the production zone and the separator is in fluid communication with the injection zone.

3. The system of claim 2 wherein there is a conduit between the injection zone and the encapsulated device.

4. The system of claim 3 wherein the conduit is tubing placed in the wellbore between the first and second packer.

5. The system of claim 1 further comprising a sensor device mounted above the pressure seal to measure fluid and mechanical conditions and a control device capable of regulating said conditions.

6. The system of claim 5 further comprising a sensor device located in the encapsulated device between the separator and the pump outlet to measure fluid and mechanical conditions and a control device capable of regulating said conditions within the encapsulated device.

7. The system of claim 6 further comprising a sensor device mounted between the separator and a well head, to measure fluid and mechanical conditions and a control device capable of regulating said conditions.

8. The system of claim 1 wherein the separator is a rotary separator.

9. The system of claim 8 where the connection between the separator and the device is capable of transferring torque.

10. The system of claim 9 further comprising a sensor device mounted adjacent the pressure seal to measure fluid and mechanical conditions and a control device capable of regulating said conditions within the encapsulated device.

11. The system of claim 10 further comprising a sensor device mounted between the separator and the pump outlet located adjacent the separator to measure fluid and mechanical conditions and a control device capable of regulating said conditions within the encapsulated device.

12. The system of claim 11 further comprising a sensor device mounted between the separator and a well head, to measure fluid and mechanical conditions and a control device capable of regulating said conditions.

13. The system of claim 12 wherein there is a second encapsulated device disposed in the wellbore in fluid communication with the separator for increasing the pressure of the produced hydrocarbon and water mixture.

14. The system of claim 1 wherein the upper connection is a hanger connection comprising:

a hanger body forming a first chamber and a second chamber and having an upper surface and a lower surface such that the hanger body can be supported by the device body;

the first chamber having a means of connecting the pump assembly to the hanger body; and the second chamber having a means of connecting a cable connection to the hanger body; and wherein the pressure seal is located between the device body and the hanger body and is capable of isolating pressure below the hanger body from pressure above the hanger body.

15. The system of claim 14 wherein the upper connection has a screw type connection in the first chamber.

16. The system of claim 1 wherein the lower connection is a base connection comprising:

a base body forming a chamber having an upper surface and a lower surface such that the base body can be supported by the device body;

the base body having an outer surface and an inner surface such that the outer surface has has a means of connecting the device to other objects; and the lower surface containing the encapsulated device inlet.

17. The system of claim 1 wherein there is a second encapsulated device disposed in the wellbore and in fluid communication with the separator for pressurizing the produced hydrocarbon and water mixture.

18. The system of claim 1 wherein there is a second production pump disposed in the wellbore and in fluid communication with the separator for pressurizing the hydrocarbon-rich stream.

19. A method for separating hydrocarbon from water using a downhole water separation system, the method comprising:

disposing a packer in a wellbore such that the packer separates a production zone from an injection zone;

drawing a produced hydrocarbon and water mixture into a separator having an inlet and a first and second outlet such that the mixture enters from the production zone through the inlet and is separated into an hydrocarbon-rich stream and a water-rich stream that can be ejected through the first and second outlets respectively; and using an encapsulated device in fluid communication with the separator for pressurizing the hydrocarbon and water mixture for separation, the encapsulated device comprising:

a device body forming a chamber having an upper and lower surface such that the upper surface includes a device outlet and an upper connection with a pressure seal and the lower surface includes a lower connection and a device inlet in fluid communication with the produced hydrocarbon and water mixture;

a pump assembly supported by the device body, with a pump inlet in fluid communication with the produced hydrocarbon and water mixture and a pump outlet in fluid communication with the pressure sealed device outlet; and an electric submersible motor assembly.

* * * * *

UNITED STATES PATENT AND TRADEMARK OFFICE

CERTIFICATE OF CORRECTION

PATENT NO. : 6,457,531 B1 
DATED : October 1, 2002
INVENTOR(S) : Yasser Khan Bangash and Michael R. Berry It is certified that error appears in the above-identified patent and that said Letters Patent is hereby corrected as shown below:

Column 1,
Line 65, replace “also arc” with -- also are --

Column 4,
Line 11, replace “72a minimum” with -- 72 a minimum --
Line 60, replace “isolating, the” with -- isolating the --
Line 61, replace “above tile hanger” with -- above the hanger --
Line 65, replace “forming, a” with -- forming a --

Column 5,
Line 4, replace “feature, Such” with -- feature, such --
Line 5, replace “lip, Coupled” with -- lip, coupled --
Line 6, replace “outer Surface” with -- outer surface --
Line 21, replace “zone 18 This” with -- zone 18. This --
Line 22, replace “require a chance” with -- require a change --
Line 67, replace “means, Such” with -- means, such --

Column 6,
Line 29, replace “into an hydrocarbon” with -- into a hydrocarbon --

Signed and Sealed this

Twenty-fifth Day of February, 2003

JAMES E. ROGAN
*Director of the United States Patent and Trademark Office*